US006666450B2

(12) United States Patent
Slocum et al.

(10) Patent No.: US 6,666,450 B2
(45) Date of Patent: Dec. 23, 2003

(54) SWING GATE

(75) Inventors: Douglas A. Slocum, New Milford, PA (US); Patrick J. Fitzgibbons, Newark Valley, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 136 days.

(21) Appl. No.: 10/059,425

(22) Filed: Jan. 31, 2002

(65) Prior Publication Data

US 2003/0141658 A1 Jul. 31, 2003

(51) Int. Cl.[7] ..... B65H 31/28
(52) U.S. Cl. ..... 271/218; 414/793.4; 209/900
(58) Field of Search ..... 271/280, 298, 271/292, 294, 213, 218; 209/900, 655, 657; 414/793.4, 791

(56) References Cited

U.S. PATENT DOCUMENTS 4,785,942 A 11/1988 Van Leijenhorst et al.
4,867,437 A 9/1989 Wise
5,060,929 A * 10/1991 Kohlmann ..... 271/218
5,186,336 A * 2/1993 Pippin et al. ..... 209/583
5,242,261 A * 9/1993 Pollich et al. ..... 414/795.8
5,284,339 A * 2/1994 van Opstal et al. ..... 271/288
5,509,537 A 4/1996 Crismon et al.
6,036,026 A 3/2000 Tranquilla
6,126,017 A * 10/2000 Hours ..... 209/698
6,394,741 B1 * 5/2002 Lehtimaki ..... 414/790.8

* cited by examiner

*Primary Examiner*—Donald P. Walsh
*Assistant Examiner*—Katlin Joerger
(74) *Attorney, Agent, or Firm*—Schwartz & Weinrieb

(57) ABSTRACT

A drop-box mechanism or system is disposed adjacent to an article conveyor and atop a flat mail storage tub and comprises a platen movable between first and second chambers at which the open top of the storage tub is respectively uncovered and covered. When the platen uncovers the storage tub, deflecting fingers move downwardly so as to cover the platen tracks and the space defined between the bottom of the drop-box mechanism and the open top of the storage tub so as to prevent flat mail articles from becoming jammed within the tracks or from being inadvertently discharged through the space defined between the bottom of the drop-box mechanism and the open top of the storage tub. In this manner, the predetermined conveyed order of articles is preserved so as to facilitate sequence address delivery of the articles to recipients.

27 Claims, 2 Drawing Sheets

SWING GATE

FIELD OF THE INVENTION

The present invention relates generally to flat mail conveying, handling, sorting, and stacking systems, and more particularly to a new and improved implement for use in connection with flat mail conveying, handling, sorting, and stacking systems wherein, when flat mail articles, pieces, or units, such as, for example, envelopes, letters, newspapers, catalogs, magazines, greeting cards, post cards, fliers, and the like, are delivered to a predetermined sorting or storage container, bin, or tub destination, the implement will be activated or moved toward, or be disposed in, a particular orientation so as to effectively prevent an erroneous or misdirected discharge of the flat mail articles, units, or pieces from the system conveying structure such that jamming of the system occurs, or alternatively, the conveyed mail articles, pieces, or units are no longer in their original predetermined sorted order which is indispensable in connection with current automatic processing and sequenced delivery of mail pieces or units to recipients.

BACKGROUND OF THE INVENTION

In automatic flat mail conveying, handling, sorting, and stacking systems, flat mail articles, pieces, or units, such as, for example, envelopes, letters, newspapers, catalogs, magazines, greeting cards, post cards, fliers, and the like, are initially conveyed by means of a suitable conveyor belt system, they are subsequently scanned, such as, for example, by means of a suitable bar code reader (BCR) or an optical character recognition (OCR) reader so as to be sorted, such as, for example, by means of destination address information, and conveyed further toward predetermined sorting or storage containers, bins, or tubs. In accordance with current automatic processing and sequenced delivery systems for delivering mail pieces or units to recipients in accordance with the serial order of street delivery addresses, it is imperative that the particular flat mail articles, pieces, or units of mail are not only conveyed to and deposited within the correct sorting or storage container, bin, or tub, but in addition, that the flat mail articles, pieces, or units disposed within a particular sorting or storage container, bin, or tub be disposed and retained in a particular order corresponding to the delivery address sequence.

In connection with one type of system used in connection with the deposition of flat mail articles, pieces, or units into predetermined sorting or storage containers, bins, or tubs, the containers, bins, or tubs are disposed beneath a drop-box which has a movable platen member operatively associated therewith and upon which a plurality of flat mail articles, pieces, or units are initially collected or accumulated in preparation for preparing a stack of the flat mail articles, pieces, or units for subsequent deposition within the particular sorting or storage container, bin, or tub. When a predetermined amount or number of flat mail articles, pieces, or units have been collected or accumulated upon the movable platen of the drop-box, the platen is actuated so as to be effectively withdrawn from its position beneath the collected or accumulated articles, units, or pieces of flat mail piled or stacked upon the platen whereby the pile or stack of collected or accumulated articles, pieces or units of mail drops vertically downwardly in effect as a single entity into the sorting or storage container, bin, or tub so as to be disposed in a stacked or piled array within the particular sorting or storage container, bin, or tub.

Sometimes, during the course of the high-speed processing and conveyance of the various flat mail articles, pieces, or units, it is necessary or more efficient for the overall operation of the conveying and sorting system to deposit a particular article, piece, or unit of flat mail directly into the sorting or storage container without first collecting or accumulating the flat mail articles, pieces, or units upon the movable platen operatively associated with the drop-box. In other words, the particular article, piece, or unit of flat mail will be conveyed directly from the conveying mechanism, through the drop-box, and into the particular sorting or storage container, bin, or tub, thereby in effect, bypassing the drop-box. Under such circumstances, however, it has been experienced that one or more of the flat mail articles, pieces, or units, in lieu of actually being deposited into the sorting or storage container, bin, or tub, will sometimes become jammed within the track or slot defined within the drop-box framework and along which the platen moves when the same is being moved from its OPENED position to its CLOSED position, or alternatively, the particular article, piece, or unit or flat mail will sometimes be discharged through the slot or space defined between the bottom of the drop-box framework and the upper end of the sorting or storage container, bin, or tub. In either case, the efficient, orderly conveyance and stacking of the flat articles, pieces, or units of mail is operationally disrupted. In the first case, if the particular article, unit, or piece of flat mail becomes jammed, then operation of the conveying and handling system must be shut down until the jammed flat mail article, piece, or unit is able to be removed and placed in its proper order within the stack of flat mail articles, pieces, or units disposed within the sorting or storage container, bin, or tub. In the second case, operation of the conveying and handling system must likewise be shut down, and the particular article, piece, or unit of flat mail must be retrieved and likewise placed in its proper order within the stack of flat mail articles, units, or pieces disposed within the sorting or storage container, bin, or tub. In either case, the efficiency of the conveying and handling system, and the continuous operation of the same, has been compromised.

A need therefore exists in the art for a new and improved implement for use in connection with a drop-box framework mechanism which is adapted to be mounted or disposed above a flat mail sorting or storage container, bin, or tub wherein, in connection with those instances in which the platen operatively associated with the drop-box is disposed at its OPENED position so as to permit flat mail articles, pieces, or units to be directly conveyed through the drop-box and into sorting or storage container, bin, or tub, without the flat mail articles, pieces, or units being initially collected or accumulated in a stack or pile upon the platen above the sorting or storage container, bin, or tub, some means must be provided in order to effectively prevent the conveyed flat mail articles, pieces, or units from becoming jammed within the slot defined within the drop-box framework along which the platen is movable between its OPENED and CLOSED positions, as well as to effectively prevent the conveyed flat mail articles, pieces, or units from being conveyed through the slot or opening defined between the bottom of the drop-box framework and the upper end of the sorting or storage container, bin, or tub.

OBJECTS OF THE INVENTION

Accordingly, it is an object of the present invention to provide a new and improved movable structure which is operatively associated with a drop-box framework mechanism or system, and a sorting or storage container, bin, or tub, so as to operatively cooperate with the drop-box framework mechanism and system, and the movable platen member thereof, such that flat mail articles, pieces, or units can be conveyed and deposited within a predetermined flat mail sorting or storage container, bin, or tub without encountering any operational difficulties.

Another object of the present invention is to provide a new and improved movable structure which is operatively associated with a drop-box framework mechanism or system, and a sorting or storage container, bin, or tub, so as to operatively cooperate with the drop-box framework mechanism and system, and the movable platen member thereof, such that flat mail articles, pieces, or units can be conveyed and deposited within a predetermined flat mail sorting or storage container, bin, or tub without encountering any operational difficulties and thereby overcome the various operational disadvantages characteristic of conventional PRIOR ART flat mail article handling, sorting, and stacking systems.

An additional object of the present invention is to provide a new and improved movable structure which is operatively associated with a drop-box framework mechanism or system, and a sorting or storage container, bin, or tub, so as to operatively cooperate with the drop-box and the movable platen member thereof such that when the platen member is moved, relative to the drop-box, to its OPENED position, the movable structure will be disposed at a position so as to effectively prevent the jamming or misdirection of flat mail articles, pieces, or units being conveyed toward and into the sorting or storage container, bin, or tub.

A further object of the present invention is to provide a new and improved movable structure which is operatively associated with a drop-box framework mechanism or system, and a sorting or storage container, bin, or tub, so as to operatively cooperate with the drop-box and the movable platen member thereof such that when the platen member is moved, relative to the drop-box, to its OPENED position, the movable structure will be disposed at a position so as to effectively prevent the jamming or misdirection of flat mail articles, pieces, or units being conveyed toward and into the sorting or storage container, bin, or tub, and yet will not interfere with the operation of the movable platen member so as to permit the movable platen member to be moved to its CLOSED position and thereby operatively cooperate with the drop-box framework mechanism or system so as to collect and accumulate flat mail articles, pieces, or units thereon in a piled or stacked mode prior to the dropped deposition of the same into the operatively associated sorting or storage container, bin, or tub.

A last object of the present invention is to provide a new and improved movable structure which is operatively associated with a drop-box framework mechanism or system, and a sorting or storage container, bin, or tub, so as to operatively cooperate with the drop-box and the movable platen member thereof such that when the platen member is moved, relative to the drop-box, to its OPENED position, the movable structure will be disposed at a position so as to effectively prevent the jamming of any flat mail articles, pieces, or units within the track or slot defined within the drop-box framework mechanism or system along which the platen member is movable, or to similarly effectively prevent the misdirection of any flat mail articles, pieces, or units through the space or slot defined between the bottom of the drop-box mechanism or system and the upper end of the sorting or storage container, bin, or tub.

SUMMARY OF THE INVENTION

The foregoing and other objectives are achieved in accordance with the teachings and principles of the present invention through the provision of a new and improved structure which comprises a plurality of movable fingers which are either spring-biased or gravitationally moved between upper nested positions and lower deployed positions. The fingers are mounted within a housing which forms an integral part of a drop-box framework mechanism or system. A platen member is movably mounted upon the drop-box framework mechanism or system between a first OPENED position at which the drop-box framework is open so as to permit flat mail articles, pieces, or units to flow therethrough and into an operatively associated sorting or storage container, bin, or tub, and a second CLOSED position at which the platen member is disposed above the sorting or storage container, bin, or tub so as to close the drop-box framework and thereby permit flat mail articles, pieces, or units to be collected and accumulated upon the platen member in preparation for their deposition into the sorting or storage container, bin, or tub as a stacked or piled entity. When the platen member is disposed at its OPENED position, the movable fingers move downwardly to their deployed positions at which the fingers effectively block the track or slot defined within a side wall of the drop-box framework mechanism and within which the platen member is movable between its OPENED and CLOSED positions so that the flat mail articles, pieces, or units, which are being conveyed through the drop-box framework mechanism in a by-pass mode, are effectively prevented from becoming jammed within the platen member track or slot. At the same time, the fingers also block the slot or space defined between the bottom portion of the drop-box framework mechanism and the upper end portion of the sorting or storage container, bin, or tub, so that the flat mail articles, pieces, or units are effectively prevented from being conducted through the slot or space defined between the bottom of the drop-box framework mechanism and the upper end portion of the sorting or storgage container, bin, or tub. In either case, continuous operation of the flat mail article sorting, handling, and stacking operations is achieved, and the specific serial order, in which the flat mail articles, pieces, or units were conveyed, is preserved so as to facilitate automatic processing and delivery sequence of the flat mail articles, pieces, or units to their respective destinations and recipients. When the platen member is movable to the CLOSED position, the platen member will engage the movable fingers and bias the same upwardly so that the platen member may be readily moved to its CLOSED position so as to achieve its flat mail article collection and accumulation mode.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
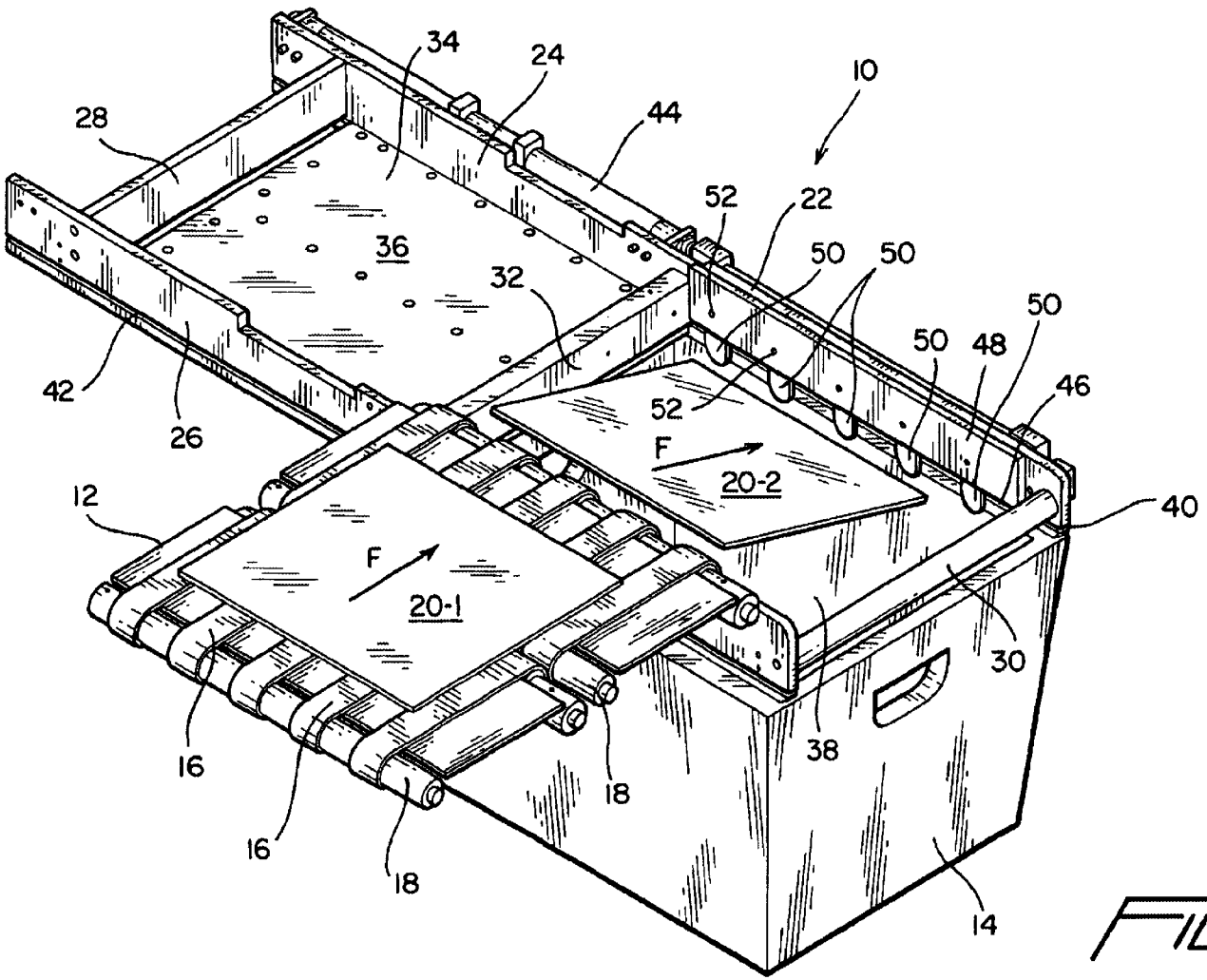
FIG. 1 is a perspective view of a new and improved drop-box framework mechanism or system, having the blocking fingers operatively mounted therein and shown in operative cooperation with a sorting or storage container, bin, or tub, wherein the fingers are disposed at their employed positions in conjunction with the disposition of the platen member at its OPENED position.
Figure 2:
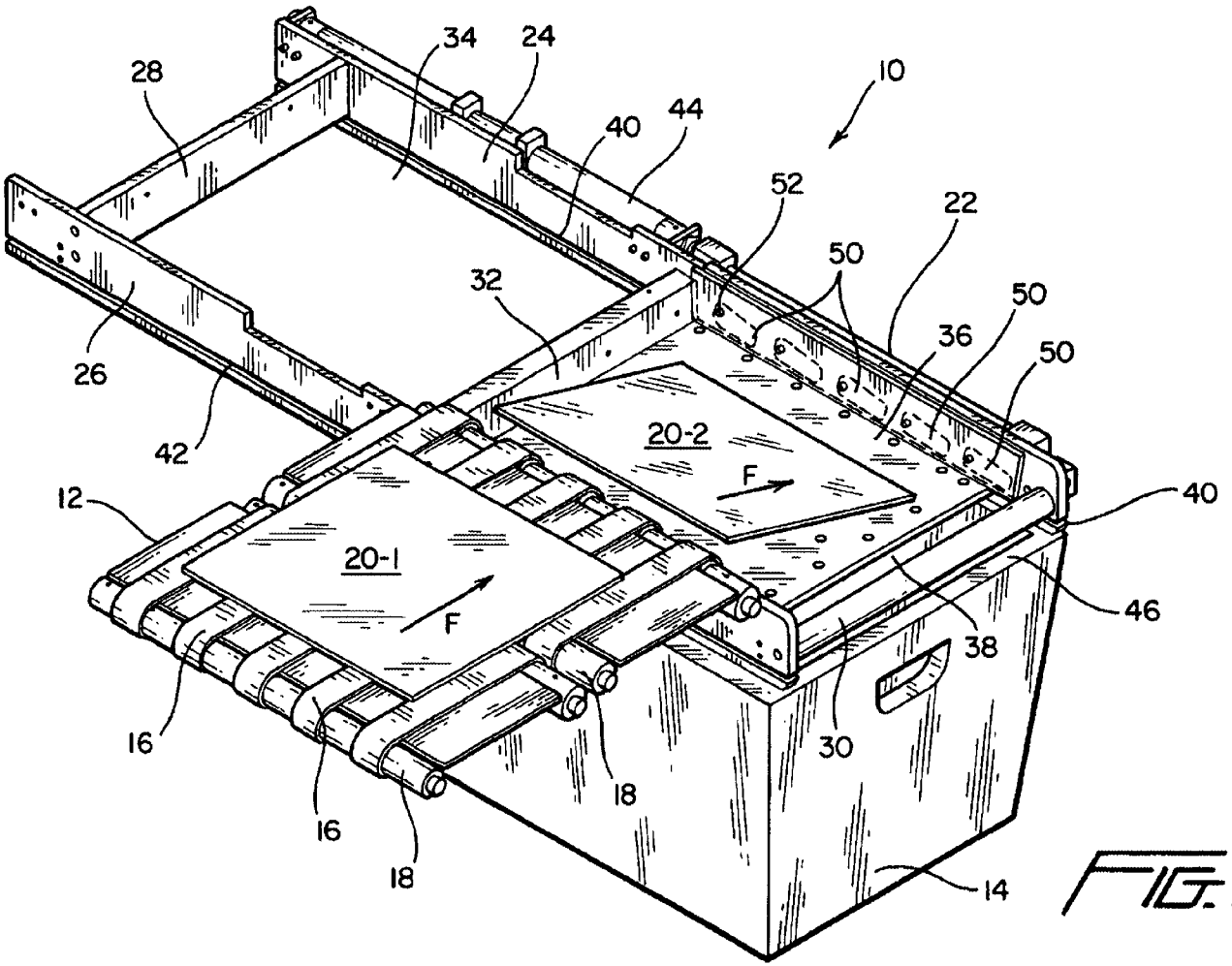
FIG. 2 is a perspective view of the new and improved drop-box framework mechanism or system, having the blocking fingers operatively mounted therein and shown in operative cooperation with a sorting or storage container, bin, or tub, wherein the fingers are disposed at their retracted or nested positions in conjunction with the disposition of the platen member at its CLOSED position.

Referring now to the drawings, and more particularly to FIGS. 1 and 2 thereof, a new and improved drop-box framework mechanism or system, constructed in accordance with the principles and teachings of the present invention, is disclosed and is generally indicated by the reference character 10. More particularly, the new and improved drop-box framework mechanism or system 10 is adapted to be used in connection with a suitable belt conveyor 12 which is used to convey a plurality of articles, pieces, or units of flat mail toward and into a particular or predetermined one of a plurality of sorting or storage containers, bins, or tubs 14 within which the plurality of articles, pieces, or units of flat mail are adapted to be stacked in a predetermined sequence or order corresponding to, for example, the serial arrangement of street delivery addresses to which the plurality of pieces, articles, or units of flat mail are to be delivered to their respective recipients. The belt conveyor 12 conventionally comprises a plurality of laterally spaced conveyor belts 16 which are disposed around a plurality of conveyor belt roller shafts 18 at least one of which, for each conveyor belt section, is driven by means of a suitable motor drive, not shown, so as to in turn drive the conveyor belts 16. In this manner, the individual flat mail articles, pieces, or units, such as, for example, flat mail pieces 20-1 and 20-2 are able to be longitudinally conveyed toward the particular sorting or storage container, bin, or tub 14 as designated by the arrows F.

Operatively associated with the belt conveyor mechanism 12, and disposed above the particular sorting or storage container, bin, or tub 14 in a suspended mode by suitable means, not shown, there is provided a drop-box mechanism or system 22 which comprises a pair of oppositely disposed, laterally or transversely extending side rails or frame members 24,26, as considered in connection with or with respect to the longitudinal conveyance of the flat mail articles, pieces, or units 20-1,20-2, a pair of longitudinally extending end frame members 28,30 which secure opposite end portions of the side rails or frame members 24,26 together, and a central, longitudinally extending frame member 32. It is thus appreciated that the central longitudinal frame member 32 of the drop-box mechanism or system 22 effectively cooperates with the oppositely disposed side rails or frame members 24,26 and end frame member 28 of the drop-box mechanism or system 22 so as to define a first drop-box chamber 34 within which a movable platen 36 can be disposed when the platen 36 is disposed at its OPENED position, as shown in FIG. 1, whereby the platen 36 is effectively disposed remote from the sorting or storage container, bin, or tub 14. At such position, the open top of the conventional PRIOR ART sorting or storage container, bin, or tub 14 is uncovered and thereby rendered accessible to incoming conveyed articles, pieces, or units of flat mail. In a similar manner, central longitudinal frame member 32 effectively cooperates with the oppositely disposed side rails or frame members 24, 26 and end frame member 30 so as to define a second chamber 38 within which the movable platen 36 can be disposed when the platen 36 is disposed at its CLOSED position atop the conventional PRIOR ART sorting or storage container, bin, or tub 14 as shown in FIG. 2 whereby the open top of conventional PRIOR ART sorting or storage container, bin, or tub 14 is covered and rendered inaccessible to incoming conveyed articles, pieces, or units of flat mail.

It is further seen that each one of the oppositely disposed side rails or frame members 24,26 of the drop-box mechanism or system 22 is provided with a transversely extending slot 40,42 which serve as tracks within which opposite side edge portions of the movable platen 36 are slidably disposed so as to permit the movable platen 36 to be moved between its aforenoted OPENED and CLOSED positions. In order to achieve the transverse movement of the movable platen 36 between the aforenoted OPENED and CLOSED positions, a pneumatic actuator 44 is mounted upon an outside or external portion of side rail or frame member 24 by suitable means, not shown, and the actuating piston member, not shown, of the pneumatic actuator 44 is operatively connected to the movable platen 36. Accordingly, for example, when the pneumatic actuator 44 is actuated such that the piston member, not shown, thereof is extended, the movable platen 36 will be moved to its aforenoted CLOSED position as shown in FIG. 2 whereby the open top of the conventional PRIOR ART sorting or storage container, bin, or tub 14 will be covered and rendered inaccessible to incoming conveyed articles, pieces, or units of flat mail, whereas when the pneumatic actuator 44 is actuated such that the piston member, not shown, thereof is retracted, the movable platen 36 will be moved to its aforenoted OPENED position as shown in FIG. 1 whereby the open top of the conventional PRIOR ART sorting or storage container, bin, or tub 14 will be uncovered and rendered accessible to incoming conveyed articles, pieces, or units of flat mail.

The reason that the platen 36 is movable between its OPENED and CLOSED positions is that depending, for example, upon the type of flat mail articles, pieces, or units being conveyed toward the sorting or storage container, bin, or tub 14 by means of the conveyor system 12, the platen 36 can be disposed either in its OPENED state, as illustrated in FIG. 1, by means of which the incoming conveyed articles, pieces, or units of flat mail 20-1,20-2 may be directly and rapidly inserted into and deposited within the sorting or storage container, bin, or tub 14 as a result of being conducted through the drop-box mechanism or system 22 in a by-pass mode, or alternatively, the platen 36 can be disposed in its CLOSED state, as illustrated in FIG. 2, by means of which the incoming conveyed articles, pieces, or units of flat mail 20-1,20-2 will be collected, accumulated, and stacked upon the platen 36.

When a predetermined number, or particular ones, of the incoming conveyed flat mail articles, pieces, or units 20-1, 20-2 have been collected, accumulated, and stacked upon the platen 36, the pneumatic actuator 44 is activated so as to rapidly remove the platen 36 from its CLOSED position of FIG. 2, at which it is disposed beneath the collected, accumulated, and stacked flat mail articles, pieces, or units, to its OPENED position of FIG. 1 whereby the collected, accumulated, and stacked flat mail articles, units, or pieces are then simply dropped vertically downwardly into the sorting or storage container, bin, or tub 14. It is to be noted that activation of the pneumatic actuator 44, and therefore, movement of the platen 36 between its OPENED and CLOSED states, may be suitably controlled by means of a central processing unit (CPU), not shown, which is also operatively connected to, for example, suitable bar code reader (BCR) or optical character recognition (OCR) reader apparatus so as to track the conveyance of the individual articles, pieces, or units of flat mail along the conveyor mechanism 12.

When the platen 36 is disposed in its OPENED state as illustrated in FIG. 1 such that the various articles, pieces, or units of flat mail 20-1,20-2 are being conveyed through the drop-box mechanism or system 22 in the aforenoted by-pass mode and directly into the sorting or storage container, bin, or tub 14, it sometimes occurs that a particular one of the flat mail articles, pieces, or units can become lodged within that portion of the platen track 40 which is operatively associated with chamber 38 of the drop-box mechanism or system 22. As a consequence of such, the particular flat mail article, piece, or unit becomes jammed within the system necessitating shut-down of the system until the jammed article, piece, or unit of flat mail has been removed. In a similar manner, it may sometimes occur that, as a particular one of the flat mail articles, pieces, or units is being discharged from the conveyor mechanism 12, and in lieu of such flat mail article, piece, or unit being desirably deposited into the sorting or storage container, bin, or tub 14, the flat mail article, piece, or unit may be inadvertently discharged from the drop-box mechanism or system 22 as a result of having passed through a slot or space 46 which is defined between the bottom portion of the drop-box mechanism or system 22 and the upper ends or open top of the sorting or storage container, bin, or tub 14. As a consequence of such, the particular article, piece, or unit of flat mail will be temporarily lost, it must be retrieved, and it must be replaced within the original serial order of the flat mail articles, pieces, or units being conveyed so as to preserve the integrity of the address delivery sequence of the articles, pieces, or units of flat mail to be delivered to their respective recipients.

Therefore, in accordance with the principles and teachings of the present invention, the drop-box framework mechanism or system 22 is provided with means for effectively preventing the aforenoted undesirable events from occurring. More particularly, that portion of side rail or frame member 24 which is operatively associated with drop-box chamber 38 has a housing 48 fixedly mounted thereon, and a plurality of blocking fingers 50 are pivotally mounted within the housing 48 by means of suitable trunnions or pivot pins 52. The fingers 50 may either be spring-biased downwardly by suitable biasing springs, not shown, or alternatively, may simply be gravitationally biased. In either one of the aforenoted cases or instances, when the movable platen 36 is disposed at its OPENED position as illustrated in FIG. 1 such that the flat mail articles, pieces, or units 20-1,20-2 are conveyed through the drop-box mechanism or system 22 in the bypass mode so as to be deposited directly into the sorting or storage container, bin, or tub 14, the blocking fingers 50 will have moved downwardly to their blocking positions at which both that portion of the platen track 40 which is operatively associated with chamber 38 of the drop-box mechanism or system 22, as well as space or slot 46 defined between the bottom portion of the drop-box mechanism or system 22 and the upper open end of the sorting or storage container, bin, or tub 14, will effectively be blocked. Accordingly, if any one of the flat mail articles, pieces, or units tends to become jammed within that portion of the platen track 40 which is operatively associated with chamber 38 of the drop-box mechanism or system 22, or tends to be discharged through the space or slot 46 defined between the bottom portion of the drop-box mechanism or system 22 and the upper open end of the sorting or storage container, bin, or tub 14, the blocking fingers 50 will tend to deflect such article, piece, or unit of flat mail downwardly into the sorting or storage container, bin, or tub 14 such that the article, piece, or unit of flat mail can be stacked therein.

Alternatively, when the platen 36 is moved from the OPENED position as shown in FIG. 1 to the CLOSED position as shown in FIG. 2, that portion of the platen 36, which is disposed immediately adjacent to the edge portion of the platen 36 which is slidably disposed within that portion of the platen track 40 which is operatively associated with chamber 38 of the drop-box mechanism or system 22, will encounter the downwardly dependent blocking fingers 50 so as to effectively cause the same to be pivoted upwardly upon their respective pivot pins 52 such that the blocking fingers 50 will be nested internally within the housing 48 as illustrated in FIG. 2. The fingers 50 therefore do not interfere with the slidable movements of the platen 36 between its OPENED and CLOSED positions, and when the platen 36 is disposed at the CLOSED position as illustrated in FIG. 2, it is noted that the edge portion of the platen 36 is disposed within that portion of the platen track 40 which is operatively associated with chamber 38 of the drop-box mechanism or system 22 so as to effectively cover that portion of the platen track 40. In addition, the platen 36 simultaneously covers the space or slot 46 defined between the bottom portion of the drop-box mechanism or system 22 and the upper open end of the sorting or storage container, bin, or tub 14. Therefore, again, that portion of the platen track 40 which is operatively associated with chamber 38 of the drop-box mechanism or system 22, as well as space or slot 46 defined between the bottom portion of the drop-box mechanism or system 22 and the upper open end of the sorting or storage container, bin, or tub 14, will effectively be blocked so as to prevent the jamming of any flat mail article, unit, or piece within the platen track 40, or alternatively, the erroneous discharge of any flat mail article, piece, or unit through the space or slot 46.

Thus, it may be seen that in accordance with the principles and teachings of the present invention, a new and improved drop-box mechanism or system has been provided wherein a plurality of pivotal, nestable fingers have been provided upon the drop-box mechanism or system framework such that when the movable platen is moved to its OPENED position, the fingers pivot downwardly so as to effectively cover and block a portion of the platen track as well as the space or slot defined between the bottom of the drop-box mechanism or system and the open upper end of the flat mail sorting or storage container, bin, or tub so as to prevent any flat mail article, piece, or unit from becoming jammed within the platen track or from being erroneously discharged through the space or slot defined between the bottom of the drop-box mechanism or system and the open upper end of the flat mail sorting or storage container, bin, or tub. In this manner, operational downtime of the system due to such jamming of the flat mail articles, pieces, or units is obviated, and erroneous arrangement of the flat mail articles, units, or pieces with respect to the predetermined sequential delivery address order is likewise prevented.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A drop-box system for receiving articles conveyed by an article conveyor and for permitting the conveyed articles to be deposited into an open top storage tub, comprising:

a drop-box framework adapted to be disposed adjacent to an article conveyor so as to be capable of receiving articles conveyed by the article conveyor, and adapted to be disposed above an open top storage tub by means of a predetermined space so as to permit the conveyed articles to be deposited into the storage tub;

a pair of chambers defined within said drop-box framework such that a first one of said pair of chambers is disposed relatively remote from the article conveyor and the storage tub, while a second one of said pair of chambers is disposed relatively adjacent to the article conveyor and the storage tub;

a platen movable along tracks, defined within said drop-box framework, between said first and second chambers defined within said drop-box framework such that when said platen is disposed within said first chamber defined within said drop-box framework, the open top of the storage tub is uncovered so as to permit the conveyed articles to pass directly from the article conveyor and into the storage tub, whereas when said platen is disposed within said second chamber defined within said drop-box framework, the open top of the storage tub is covered such that articles conveyed by the article conveyor are accumulated upon said platen;

means for moving said movable platen between said first and second chambers defined within said drop-box framework; and means for covering said platen tracks and the space defined between the drop-box framework and the open top of the storage tub, when said platen is disposed within said first chamber such that the open top of the storage container is uncovered, so as to prevent any conveyed article from becoming jammed within said platen tracks, and to prevent any conveyed article from being discharged through the space defined between the drop-box framework and the open top of the storage tub, such that the conveyed articles are properly deposited into the storage tub.

2. The system as set forth in claim 1, wherein:

said means for moving said movable platen comprises a pneumatic actuator.

3. The system as set forth in claim 1, wherein:

said means for covering said platen tracks and the space defined between said drop-box framework and the open top of the storage tub comprises a plurality of movable fingers.

4. The system as set forth in claim 3, wherein:

said movable fingers are movably mounted upon said drop-box framework.

5. The system as set forth in claim 4, wherein:

said movable fingers are movably mounted upon a side frame member of said drop-box framework which defines a portion of said second chamber of said drop-box framework.

6. The system as set forth in claim 5, wherein:

a housing is mounted upon said side frame member of said drop-box framework; and said movable fingers are mounted upon said housing so as to be movable between first positions at which said movable fingers project outwardly from said housing so as to cover said platen tracks and the space defined between said drop-box framework and the open top of the storage tub when said platen is disposed within said first chamber of said drop-box framework, and second positions at which said movable fingers are nested within said housing so as to permit said platen to move along said platen tracks from said first chamber of said drop-box framework and into said second chamber of said drop-box framework so as to cover the space defined between said drop-box framework and the open top of the storage tub.

7. The system as set forth in claim 6, wherein:

said movable fingers are pivotally mounted upon trunnions mounted within said housing.

8. The system as set forth in claim 7, wherein:

said movable fingers are moved downwardly under the influence of gravity to said first positions from said second positions, and are engaged by said movable platen, as said movable platen is moved from said first chamber to said second chamber, so as to be moved from said first outwardly projecting positions back to said second nested positions.

9. The system as set forth in claim 7, wherein:

said movable fingers are spring-biased downwardly to said first positions from said second positions, and are engaged by said movable platen, as said movable platen is moved from said first chamber to said second chamber, so as to be moved from said first outwardly projecting positions back to said second nested positions.

10. In combination, a system for handling articles conveyed by an article conveyor and for permitting the conveyed articles to be deposited into an open top storage tub, comprising:

an article conveyor;

a drop-box framework disposed adjacent to said article conveyor so as to be capable of receiving articles conveyed by said article conveyor, and adapted to be disposed above an open top storage tub by means of a predetermined space so as to permit the conveyed articles to be deposited into the storage tub;

a pair of chambers defined within said drop-box framework such that a first one of said pair of chambers is disposed relatively remote from said article conveyor and the storage tub, while a second one of said pair of chambers is disposed relatively adjacent to said article conveyor and the storage tub;

a platen movable along tracks, defined within said drop-box framework, between said first and second chambers defined within said drop-box framework such that when said platen is disposed within said first chamber defined within said drop-box framework, the open top of the storage tub is uncovered so as to permit the conveyed articles to pass directly from said article conveyor and into the storage tub, whereas when said platen is disposed within said second chamber defined within said drop-box framework, the open top of the storage tub is covered such that articles conveyed by said article conveyor are accumulated upon said platen;

means for moving said movable platen between said first and second chambers defined within said drop-box framework; and means for covering said platen tracks and the space defined between the drop-box framework and the open top of the storage tub, when said platen is disposed within said first chamber such that the open top of the storage container is uncovered, so as to prevent any conveyed article from becoming jammed within said platen tracks, and to prevent any conveyed article from being discharged through the space defined between the drop-box framework and the open top of the storage tub, such that the conveyed articles are properly deposited into the storage tub.

11. The combination as set forth in claim 10, wherein:

said means for moving said movable platen comprises a pneumatic actuator.

12. The combination as set forth in claim 10, wherein:

said means for covering said platen tracks and the space defined between said drop-box framework and the open top of the storage tub comprises a plurality of movable fingers.

13. The combination as set forth in claim 12, wherein:

said movable fingers are movably mounted upon said drop-box framework.

14. The combination as set forth in claim 13, wherein:

said movable fingers are movably mounted upon a side frame member of said drop-box framework which defines a portion of said second chamber of said drop-box framework.

15. The combination as set forth in claim 14, wherein:

a housing is mounted upon said side frame member of said drop-box framework; and said movable fingers are mounted upon said housing so as to be movable between first positions at which said movable fingers project outwardly from said housing so as to cover said platen tracks and the space defined between said drop-box framework and the open top of the storage tub when said platen is disposed within said first chamber of said drop-box framework, and second positions at which said movable fingers are nested within said housing so as to permit said platen to move along said platen tracks from said first chamber of said drop-box framework and into said second chamber of said drop-box framework so as to cover the space defined between said drop-box framework and the open top of the storage tub.

16. The combination as set forth in claim 15, wherein:

said movable fingers are pivotally mounted upon trunnions mounted within said housing.

17. The combination as set forth in claim 16, wherein:

said movable fingers are moved downwardly under the influence of gravity to said first positions from said second positions, and are engaged by said movable platen, as said movable platen is moved from said first chamber to said second chamber, so as to be moved from said first outwardly projecting positions back to said second nested positions.

18. The combination as set forth in claim 16, wherein:

said movable fingers are spring-biased downwardly to said first positions from said second positions, and are engaged by said movable platen, as said movable platen is moved from said first chamber to said second chamber, so as to be moved from said first outwardly projecting positions back to said second nested positions.

19. In combination, a system for handling articles conveyed by an article conveyor and for permitting the conveyed articles to be deposited into an open top storage tub, comprising:

an article conveyor;

an open top storage tub;

a drop-box framework disposed adjacent to said article conveyor so as to be capable of receiving articles conveyed by said article conveyor, and disposed above an open top storage tub by means of a predetermined space so as to permit the conveyed articles to be deposited into said storage tub;

a pair of chambers defined within said drop-box framework such that a first one of said pair of chambers is disposed relatively remote from said article conveyor and said storage tub, while a second one of said pair of chambers is disposed relatively adjacent to said article conveyor and said storage tub;

a platen movable along tracks, defined within said drop-box framework, between said first and second chambers defined within said drop-box framework such that when said platen is disposed within said first chamber defined within said drop-box framework, said open top of said storage tub is uncovered so as to permit the conveyed articles to pass directly from said article conveyor and into said storage tub, whereas when said platen is disposed within said second chamber defined within said drop-box framework, said open top of the storage tub is covered such that articles conveyed by said article conveyor are accumulated upon said platen;

means for moving said movable platen between said first and second chambers defined within said drop-box framework; and means for covering said platen tracks and said space defined between said drop-box framework and said open top of said storage tub, when said platen is disposed within said first chamber such that said open top of said storage container is uncovered, so as to prevent any conveyed article from becoming jammed within said platen tracks, and to prevent any conveyed article from being discharged through said space defined between said drop-box framework and said open top of said storage tub, such that the conveyed articles are properly deposited into said storage tub.

20. The combination as set forth in claim 19, wherein:

said means for moving said movable platen comprises a pneumatic actuator.

21. The combination as set forth in claim 19, wherein:

said means for covering said platen tracks and said space defined between said drop-box framework and said open top of said storage tub comprises a plurality of movable fingers.

22. The combination as set forth in claim 21, wherein:

said movable fingers are movably mounted upon said drop-box framework.

23. The combination as set forth in claim 22, wherein:

said movable fingers are movably mounted upon a side frame member of said drop-box framework which defines a portion of said second chamber of said drop-box framework.

24. The combination as set forth in claim 23, wherein:

a housing is mounted upon said side frame member of said drop-box framework; and said movable fingers are mounted upon said housing so as to be movable between first positions at which said movable fingers project outwardly from said housing so as to cover said platen tracks and said space defined between said drop-box framework and said open top of said storage tub when said platen is disposed within said first chamber of said drop-box framework, and second positions at which said movable fingers are nested within said housing so as to permit said platen to move along said platen tracks from said first chamber of said drop-box framework and into said second chamber of said drop-box framework so as to cover said space defined between said drop-box framework and said open top of said storage tub.

25. The combination as set forth in claim 24, wherein:

said movable fingers are pivotally mounted upon trunnions mounted within said housing.

26. The combination as set forth in claim 25, wherein:

said movable fingers are moved downwardly under the influence of gravity to said first positions from said second positions, and are engaged by said movable platen, as said movable platen is moved from said first chamber to said second chamber, so as to be moved from said first outwardly projecting positions back to said second nested positions.

27. The combination as set forth in claim 25, wherein:

said movable fingers are spring-biased downwardly to said first positions from said second positions, and are engaged by said movable platen, as said movable platen is moved from said first chamber to said second chamber, so as to be moved from said first outwardly projecting positions back to said second nested positions.

* * * * *